US005938240A

United States Patent [19]

Gairdner

[11] Patent Number: 5,938,240

[45] Date of Patent: Aug. 17, 1999

[54] CONTROL DEVICE AND METHOD FOR WHEELED SKATES AND THE LIKE

[76] Inventor: James R. Gairdner, 77 Clarendon Avenue, Suite 501, Toronto, Ontario, Canada, M4V 1J2

[21] Appl. No.: 08/598,876

[22] Filed: Feb. 9, 1996

[51] Int. Cl.[6] ..... A63C 17/28

[52] U.S. Cl. ..... 280/826; 135/85; 188/74; 280/11.2; 280/47.3

[58] Field of Search ..... 135/66, 69, 71, 135/74, 85; 188/74; 280/809, 821, 823, 826, 78, 11.2, 47.3, 47.32

[56] References Cited

U.S. PATENT DOCUMENTS

| | | | |
|---|---|---|---|
| 1,542,894 | 6/1925 | Langner | 135/66 X |
| 2,408,604 | 10/1946 | Brickson | 135/69 |
| 2,445,942 | 7/1948 | Dushinberre . | |
| 3,738,674 | 6/1973 | Pauls | 135/66 X |
| 4,194,751 | 3/1980 | Shinmura . | |
| 4,196,742 | 4/1980 | Owen, Jr. | 135/66 X |
| 4,237,915 | 12/1980 | Zabielski et al. | 135/74 X |
| 4,332,399 | 6/1982 | Kepple | 280/819 |
| 4,400,006 | 8/1983 | Larkin | 280/646 |
| 4,456,089 | 6/1984 | Kuwahara . | |
| 4,869,280 | 9/1989 | Ewing | 135/74 X |
| 4,943,075 | 7/1990 | Gates . | |
| 4,962,781 | 10/1990 | Kanbar . | |
| 5,106,110 | 4/1992 | Williamson . | |
| 5,312,135 | 5/1994 | Karabees . | |
| 5,330,207 | 7/1994 | Mitchell . | |
| 5,374,070 | 12/1994 | Pellegrini, Jr. et al. . | |
| 5,653,468 | 8/1997 | Ostapyk | 280/809 |

FOREIGN PATENT DOCUMENTS

| | | |
|---|---|---|
| 0 106 517 | 4/1984 | European Pat. Off. . |
| WO 94/21340 | 9/1994 | WIPO . |

OTHER PUBLICATIONS

Article entitled "Heel, Boy" from "Inline 1995 Aug./Sep.", p. 20.

*Primary Examiner*—J. J. Swann
*Assistant Examiner*—Michael Mar
*Attorney, Agent, or Firm*—Bereskin & Parr

[57] ABSTRACT

The invention relates to a device used by a skater for controlling speed and maintaining balance on wheeled skates. The device includes a molded elongate body with a fork for receiving a wheel at one end and a hand grip at the other end. The body includes a brake assembly for applying a braking force to the wheel or to the ground. The invention also relates to a brake pad and a wheel having corresponding tongues and grooves for frictional contact. The invention also relates to a method for learning to skate using the control device.

5 Claims, 16 Drawing Sheets

214
272
240
270
208
218
216
230
220
232
210
200

206
208
204
216
238
234
236
206
204
210

208
236
238
234
210
B

CONTROL DEVICE AND METHOD FOR WHEELED SKATES AND THE LIKE

FIELD OF THE INVENTION

This invention relates to a device and method for assisting a person in maintaining balance and controlling speed on wheeled skates and the like. It is particularly suitable for in-line skates but can also be used for other types of roller skates, and if desired for similar types of equipment, e.g. wheeled skate-skis.

BACKGROUND OF THE INVENTION

Conventional roller skates have been widely available for many decades. It is common for users of such skates, especially beginners, to have difficulty balancing or controlling their speed. Since the speeds achieved by most roller skaters were not particularly high, the incidence of injuries resulting from conventional roller skate use was relatively modest.

However, over about the last ten years, in-line roller skates have become increasingly popular. Persons using in-line roller skates tend to achieve significantly higher speeds than with conventional roller skates. Furthermore, in-line skates are being used for a great many activities including commuting on busy roadways. Accordingly, the need for adequate speed control and balance has become of much greater importance. No adequate device for controlling speed or maintaining balance using these skates has yet been developed. As a result, in-line skating has resulted in an unacceptably high incidence of injuries from falls or crashes by persons who were unable to maintain control.

Most in-line skates provide a braking pad at the rear of one boot of the skate. When the user wishes to slow down or stop, he or she is supposed to move the braking foot forwardly and tilt it rearwardly to drag the brake pad on the ground. In another version the toe is held down and the cuff is angled to cause a lever to push a rear brake pad against the ground. In either case the motion is counterintuitive and at best can only decelerate the user gradually. In an emergency stop, or where one or both skates encounter an obstacle (such as sand, gravel or grass on the road or even a very rough surface) and the wheels stop turning, the user's center of gravity rapidly shifts forwardly of the skates. As a result, it is nearly impossible for the skater to adopt the normal braking stance and a fall becomes highly likely.

Various other attempts have been made to provide brakes for in-line skates and the like. For example, as shown in U.S. Pat. No. 4,943,075, brakes have been fitted to operate on the wheels themselves. One problem with this approach is that sudden falls are still likely to occur when the skates encounter an obstacle. Also, even if the wheels are braked during an emergency stop, the user's center of gravity will continue to move forwardly and eventually lift the wheels off the ground nullifying the braking action.

A different approach is shown in U.S. Pat. No. 5,312,135. That patent shows an elongated shaft having a brakable wheel at each end. The skater carries the shaft in both hands and its use requires that the skater lean backwards into a semi-sitting position, using the shaft as a rearwardly extending support, and then apply the brake. A major problem with this device is that again, if the skates encounter an unexpected obstacle and suddenly stop (unfortunately an all too common occurrence), the skater will not have time to lean backward into a sitting position and apply the brake. Instead, the user's body will be thrust forwardly of the skates and a crash will result. If the user is able to lean backward and brake the rearwardly trailing wheel, his/her skates will tend to move forwardly in front of the user, again causing a fall.

SUMMARY OF THE INVENTION

Accordingly, the present invention provides a device and method for controlling a person's balance and speed while wearing wheeled skates (such as in-line skates).

In one aspect the present invention provides a control device for a skater wearing wheeled skates or the like, said device comprising:

(a) an elongate molded body having an upper end and a lower end;

(b) a wheel support member integrally molded at said lower end of said body;

(c) a wheel rotatably connected to said wheel support member and positioned at a positive caster relative to said body;

(d) a hand grip located at said upper end and adapted to be gripped by the user's hand; and (e) a brake assembly for braking rotary movement of said wheel.

In another aspect the invention provides a control device for a skater wearing wheeled skates or the like, said device comprising:

(a) an elongate body having an upper end and a lower end;

(b) a wheel rotatably connected to said lower end;

(c) a hand grip located at said upper end and adapted to be gripped by the user's hand; and (d) a brake pad located at said lower end for selectively engaging a ground surface, wherein, during use of said device, said brake pad is raised from the ground surface when said body is oriented above a critical angle relative to the ground with said wheel contacting said ground and said hand grip positioned comfortably in the skater's hand, and said brake pad is lowered into contact with said ground when said body is oriented below said critical angle.

In another aspect the invention provides a brake pad for a wheel, said brake pad comprising:

(a) a frictional surface for contacting said wheel; and (b) said frictional surface including at least one protruding tongue for frictionally contacting a corresponding groove defined in said wheel.

In another aspect the invention provides a wheel comprising a ground contacting portion having at least one circumferential groove that is sized to frictionally receive a corresponding tongue protruding from a frictional surface of a brake pad.

In another aspect the invention provides a method for learning to skate on wheeled skates, comprising the steps of:

(a) obtaining a control device having an elongate body with a wheel rotatably connected to one end and a handle located at the other end, said handle including a brake lever for operating a brake to control movement of the device relative to the ground;

(b) holding the handle of the device in one hand and resting the wheel of the device on the ground;

(c) gripping the brake lever;

(d) leaning toward the body of the control device while gripping the brake lever a sufficient amount to maintain a balanced position; and (e) pushing forwardly on the skates while controlling speed with the brake lever.

Further aspects of the invention will appear from the following description, taken together with the accompanying drawings.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF PREFERRED EMBODIMENTS

Reference is first made to FIGS. 1 to 8, which show a first embodiment of a control device 10 according to the invention. In several of the figures, the device is shown in use by a skater 12 wearing in-line skates 14.

Figure 2:
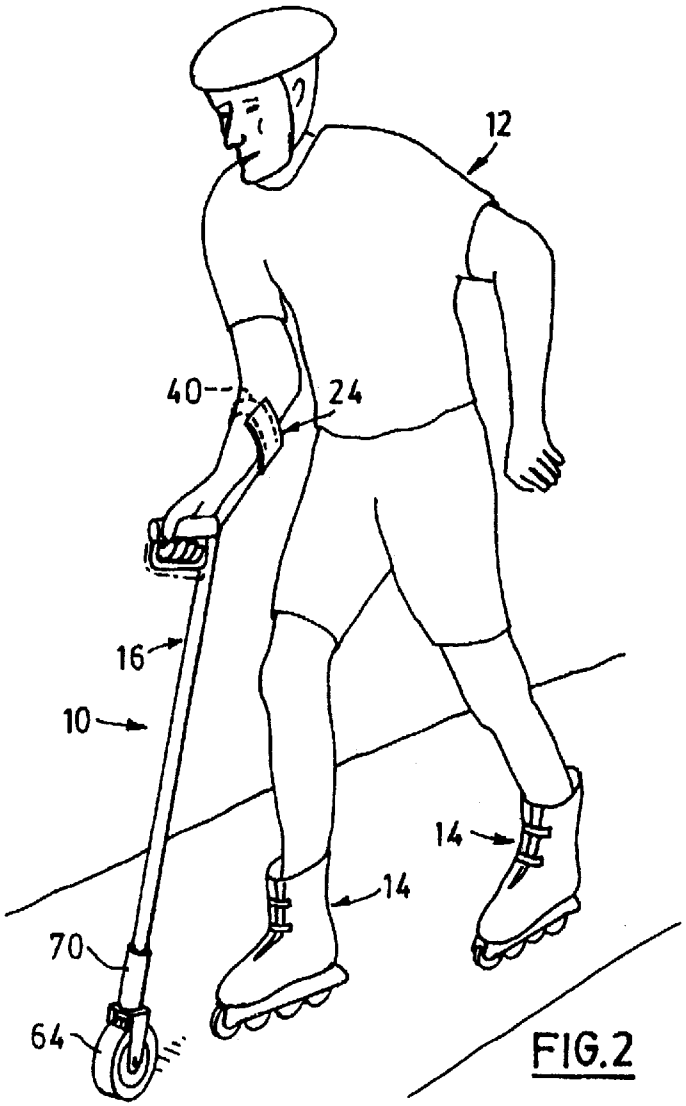
FIG. 2 is a perspective view similar to that of the FIG. 1 device, with light braking occurring.
Figure 1:
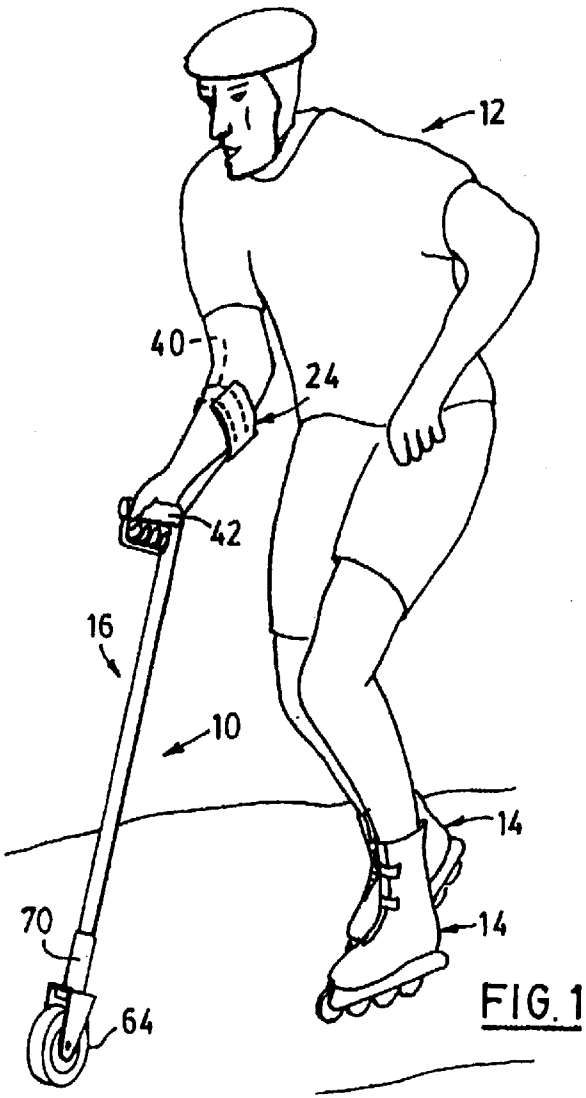
FIG. 1 is a perspective view of a first embodiment of a control device according to the invention and in use in normal skating.
Figures 3, 3A:
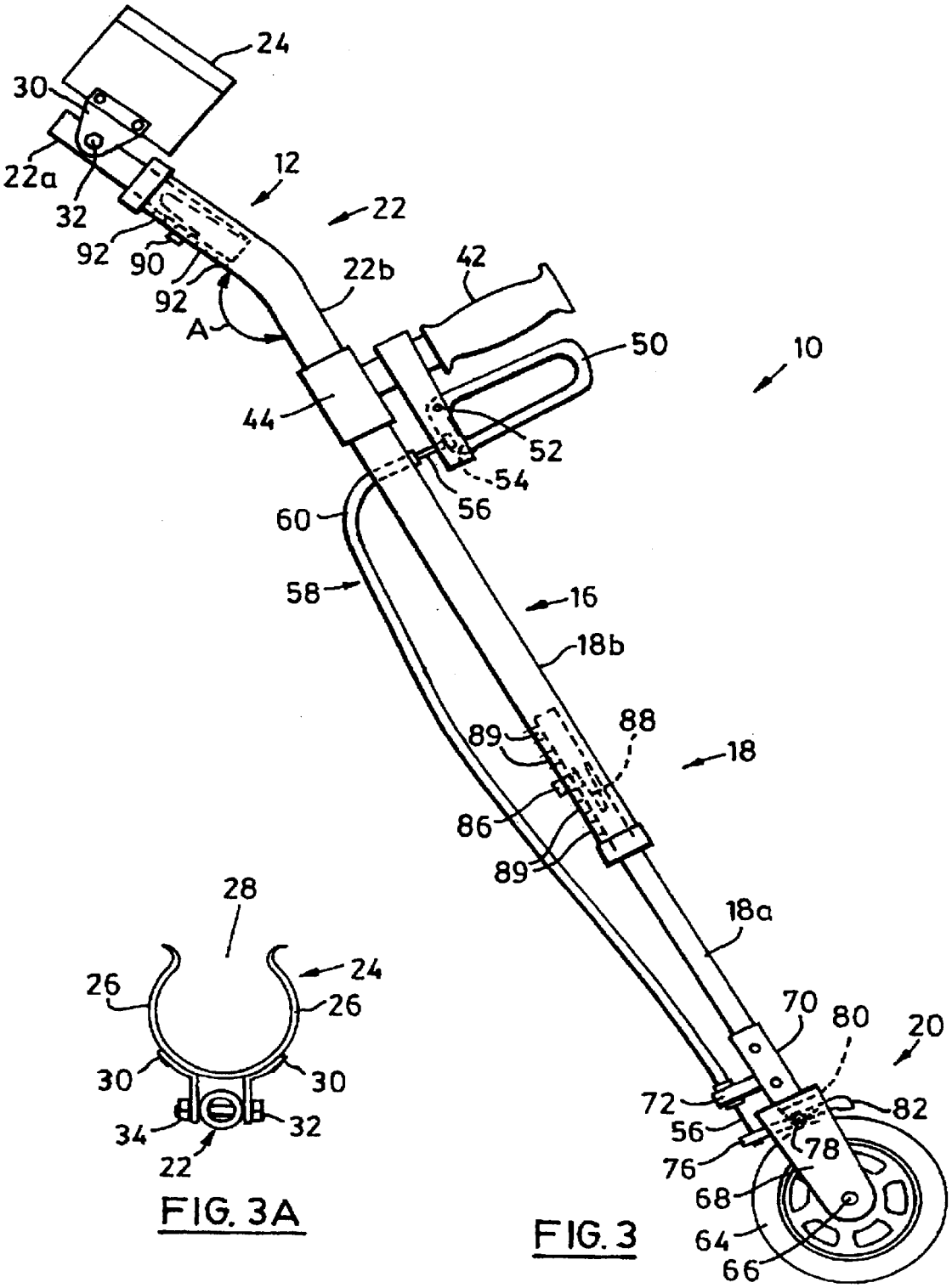
FIG. 3 is a side view of a control device according to the invention.
FIG. 3A is an end view of an arm holder of the FIG. 3 device.
Figure 4:
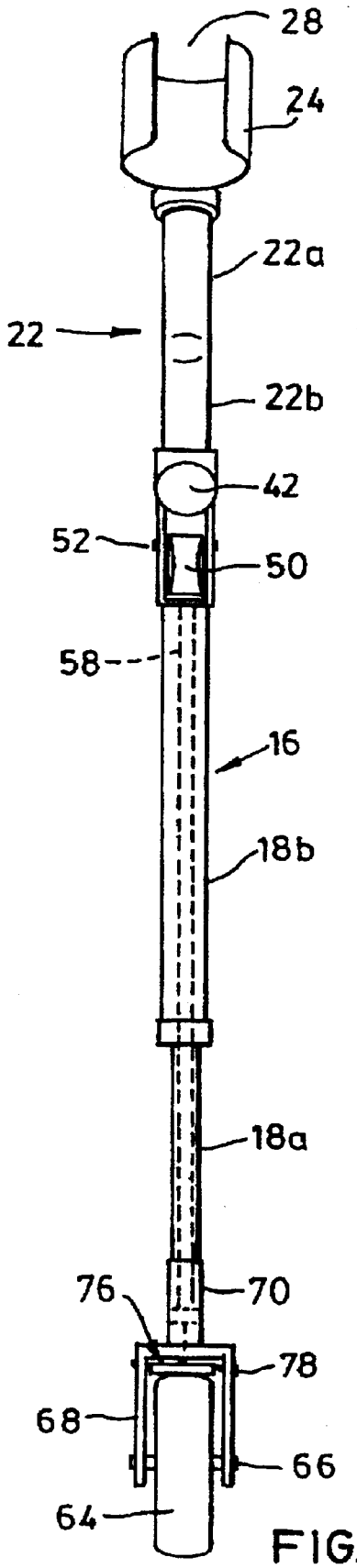
FIG. 4 is a front view of the FIG. 1 device.

As best shown in FIGS. 3, 3A and 4, the device 10 includes a body or shaft 16. The shaft 16 is typically a hollow tube formed of aluminum, plastic, graphite or other light strong material suitable for resisting substantial forces. The shaft 16 has a lower portion 18 which carries a wheel assembly 20, and an upper portion 22 which carries a C-shaped clamp or arm holder 24. The arm holder or clamp 24 (see FIG. 3A) faces upwardly and forwardly in use and is generally C-shaped, having a pair of opposed arcuate sides 26 and an opening 28 between its sides to receive the user's forearm (as shown in FIGS. 1 and 2). The arm holder 26 is connected (e.g. by rivets) to two L-shaped supports 30 which are connected to the upper shaft portion by a bolt 32 and nut 34. This allows a small degree of rocking of arm holder 24 about bolt 32, to allow some movement of the user's arm.

A strap 40, e.g. containing VELCRO (trade mark), is shown in dotted lines in FIGS. 1 and 2 wrapped around the arm holder 24 and the user's forearm to secure the upper part of the user's forearm securely to the upper part 22 of the shaft 16. (The strap 40 can be dispensed with if the arm holder 24 receives and holds the forearm relatively securely.)

In the embodiment shown there is an angle A between the upper and lower shaft portions 22, 18. Depending on the orientation in which the user prefers to hold his/her arm, the angle A can be changed or eliminated (i.e. made 180° C.).

A handle 42 projects forwardly and upwardly from the top of the lower portion 18 of the shaft 16. The handle 42 can be formed integrally with the shaft or (as shown) may have a separate collar 44 which is adhered, glued or riveted to the shaft 16. The handle 42 is positioned so that it can be gripped by the user's hand in use.

As best shown in FIG. 3, a brake lever 50 is pivotally connected at 52 to the handle 42. One end 54 of the brake lever 50 is connected to the inner wire 56 of a conventional coaxial brake cable 58 having an outer jacket 60. The upper end of the outer jacket 60 is fixed to the shaft 16.

The brake cable 58 extends down to the wheel assembly 20. As shown, the wheel assembly 20 is conventional and includes a soft rubber or similar polymeric tired wheel 64 rotatably mounted on axle 66 extending across a fork 68. Fork 68 extends downwardly from a tubular collar 70 which receives and is bolted to the lower end of shaft 16. The lower end of the brake cable outer jacket is fixed to a support 72 extending from collar 70. The inner wire 56 extends downwardly past support 72 and is connected by any suitable means to one end of a brake pad 76.

The brake pad 76 is pivotally mounted by shaft 78 on the fork 68. A coil spring indicated in dotted lines at 80 and extending around shaft 78 biases the brake pad 76 to its normal position shown in FIG. 3, in which the tip 82 of the brake pad 76 is held out of contact with the wheel 64. When the user pulls the brake handle upwardly as drawn in FIG. 3, the brake pad rotates clockwise as drawn in FIG. 3 to bring the brake pad tip 82 into frictional contact with the wheel 64.

The entire wheel and braking assembly shown is conventional and is available from commercial sources such as the Dolomite Company (who produce the same for walkers) with a distribution office in Toronto, Ontario, Canada.

The size and nature of the wheel 64 will depend to some extent on the terrain which the skater is likely to negotiate. The wheel 64 should be large enough so that it does not catch in obstacles (e.g. railway tracks, sewer grates or the like) and therefore should not normally be smaller than about 2 inches in diameter. Preferably the wheel is sufficiently large so that it will roll easily over most obstacles, since if it catches and is stopped, the skater could unexpectedly be thrust forwardly, which would be undesirable. However if the wheel 64 is too large, the device becomes unattractive and is also heavier and bulkier. Therefore the wheel 64 will not normally exceed about 7 or 8 inches in diameter. A diameter range of 4 to 6 inches is preferred. The wheel 64 may be made of various materials, e.g. soft rubber, hard rubber, plastic or the like.

Preferably, but not necessarily, the lower portion 18 of shaft 16 is made telescopic, utilizing an inner tube 18*a* which can slide inwardly and outwardly from outer tube 18*b*. A button 86, biased outwardly by a spring 88, can be located in any one of a series of holes 89 in the outer tube 18*b*, to adjust the length of the outer tube to suit the height of the person using the device. It is also contemplated that a coil spring (not shown) may be disposed between the inner tube 18*a* and outer tube 18*b* to act as a shock absorber.

Similarly, the upper portion 22 of the shaft 16 may be made telescopic by mounting the arm holder 24 on an inner tube 22*a* which slides inwardly and outwardly from the outer tube 22*b* (which is integral with tube 18*b*). Again the position of these two tubes may be fixed by a spring biased button 90 or locking pin which can extend through any of a series of holes 92 in the outer tube 22*b*. This adjusts the length of the upper portion of the device to the user's forearm.

Figure 5:
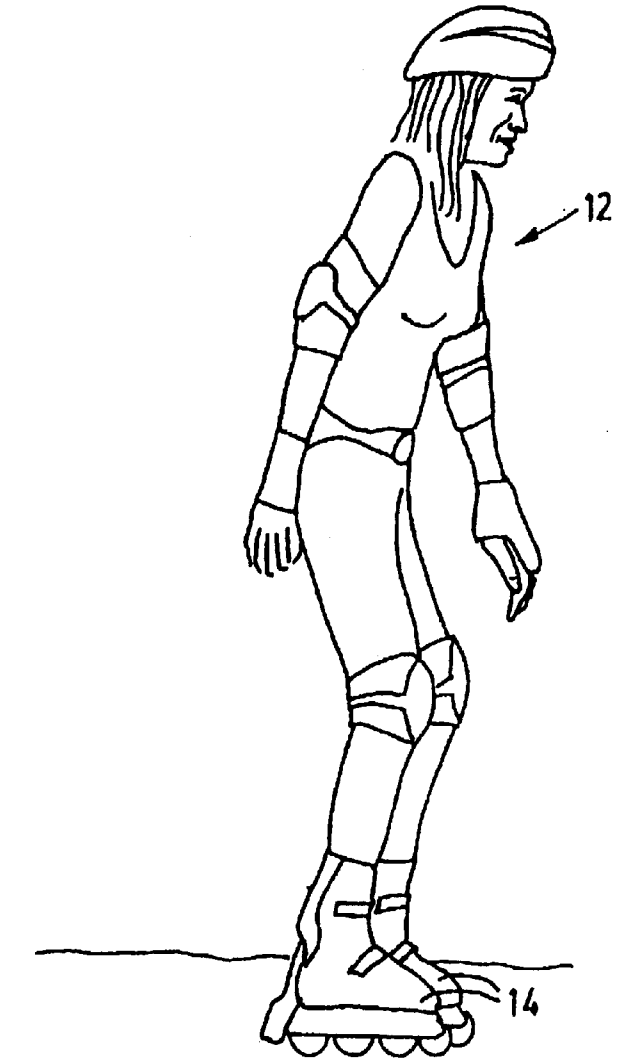
FIG. 5 is a side view showing an in-line skater in typical beginner stance.

The operation of the control device 10 is as follows. As shown in FIG. 5, a beginner skater 12 normally positions himself/herself in a position so that his/her center of gravity is over the skates 14. As the skater then moves forwardly, his/her center of gravity moves forwardly since, as is well known, normal walking or skating motion is a form of controlled fall, in which a person thrusts off with a rear foot, moving a front foot forwardly to catch the "fall" and repeating the process.

Figure 6:
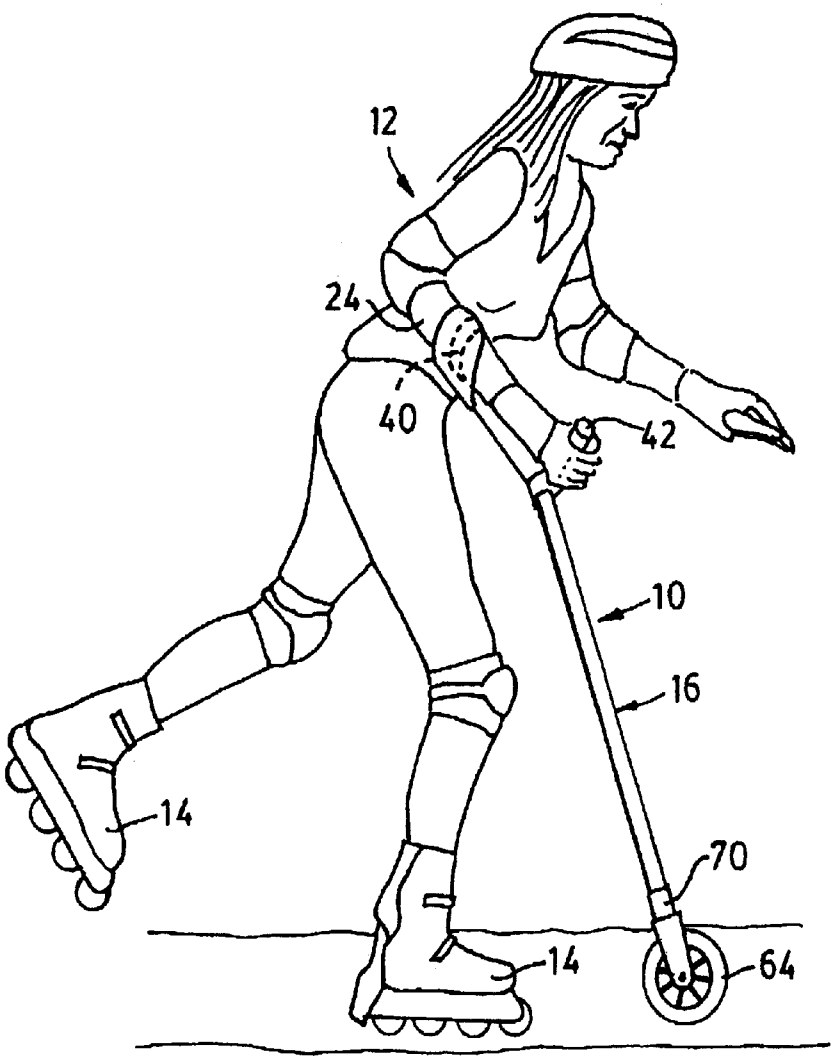
FIG. 6 is a side view showing a skater using the control device of FIGS. 1 to 5 according to the invention.

When the device 10 is used, the skater assumes the typical stance shown in FIGS. 1 and 6. The arm holder 24 is secured to the user's forearm, and the user's hand grasps handle 42 with his/her fingers normally extending around the upper part of brake lever 50, ready to pull the brake lever if necessary. The user leans forwardly in a normal stance (FIGS. 1 and 6), usually with little or no weight placed on device 10 (though it can be used as a support if desired) and with the device 10 held in front of the user by a slightly forwardly extended forearm. As shown, the device 10 extends forwardly and downwardly from the user's forearm, forming a type of triangle the sides of which include the shaft 16 and wheel 64, and the user's arm, body and legs (and the ground). When the user is leaning forwardly in normal skating, his/her center of gravity is usually slightly ahead of the user's hips but will be rearwardly of the handle 42.

If a slow stop is required, the user simply uses his/her hand to pull the braking lever 50 toward handle 42 (FIGS. 2 and 7), slowing the wheel 64 to bring the skater to a stop. During slow braking, the user's center of gravity will shift forwardly slightly, bringing additional weight to bear on the shaft 16 and wheel 64. The device 10 however acts as a support, preventing the skater from falling forwardly. In effect the skater "triangulates" on the device 10, i.e. the leg of the previously described triangle formed by device 10 now carries a portion of the user's weight.

Figure 8:
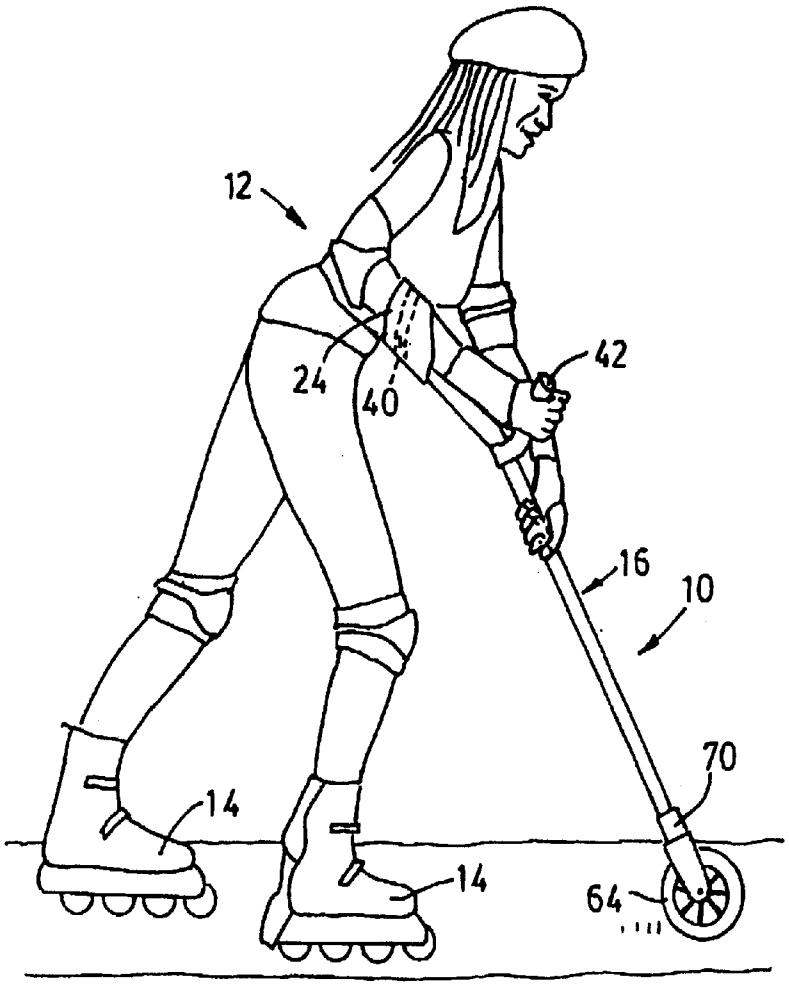
FIG. 8 is a side view similar to that of FIG. 7 but showing hard braking using the FIGS. 1 to 5.
Figure 7:
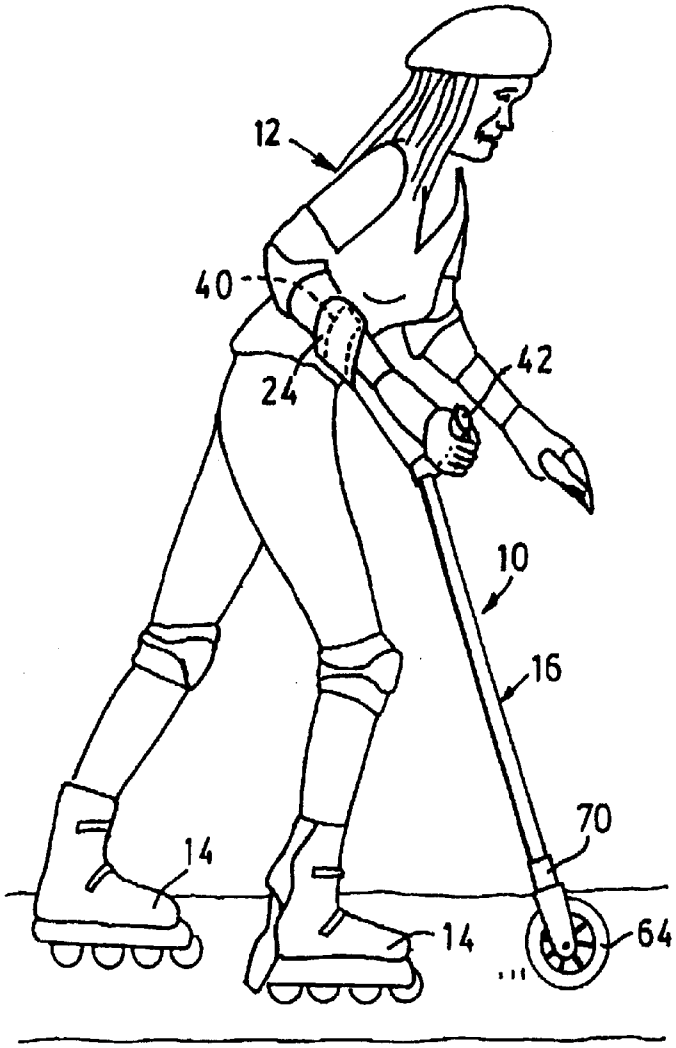
FIG. 7 is a side view similar to that of FIG. 6 but showing light braking using the FIGS. 1 to 5 device.

If emergency braking is required, e.g. if an obstacle is seen, or if the user's skates suddenly stop (because of gravel, sand or the like on the road), the user firmly pulls the brake lever 50. The user's dynamic center of gravity then rapidly shifts forwardly, as will be evident from FIG. 8. Ordinarily in a situation such as this, a serious fall would be almost inevitable. Indeed the act simply of braking rapidly will thrust the user's center of gravity forwardly, tending to cause a fall. However, with the device 10, the shaft 16 and wheel 64, which extend forwardly and downwardly, again act as a support to bear the user's forwardly shifted weight and prevent a fall. At the same time, the braking forces exerted by the wheel 64 rapidly stop the user. The additional weight transmitted through shaft 16 to wheel 64, as the user's center of gravity shifts forwardly, helps to make the braking even more effective. It is also instinctive as shown in FIG. 8, for the skater to swing his/her free hand around to grasp the shaft 16 below handle 42, during the hand braking process. This offers additional support against falling. In this process the user effectively forms a tripod with the device 10, with two legs of the tripod being formed by the user's legs, and the third leg of the tripod being formed by the user's arms and by the shaft 16 and wheel 64.

As indicated above, the device 10 may be used as a support if desired while skating. This is particularly useful as part of a method for helping beginner skaters learn how to skate such as is set out below. A skater would first hold the device 10 with the brake lever depressed to prevent any wheel movement. The skater would then assume a balanced position by supporting himself or herself against the device. The skater would then reduce pressure on the brake lever a desired amount to allow rotary movement of the wheel. At the same time, the skater would lean forwardly into the device to position his or her center of gravity over the triangulated support. By controlling the brake lever, the skater can then practice his or her skating technique at a controlled speed while maintaining balance. For instance, by controlling the brake lever to only permit a slow forward movement of the wheel, the skater can learn to thrust forwardly on his or her skates without fear of losing control. Eventually, the skater will learn to rely less and less upon the control device for support and will simply use the device for speed control as set out above.

Figure 9:
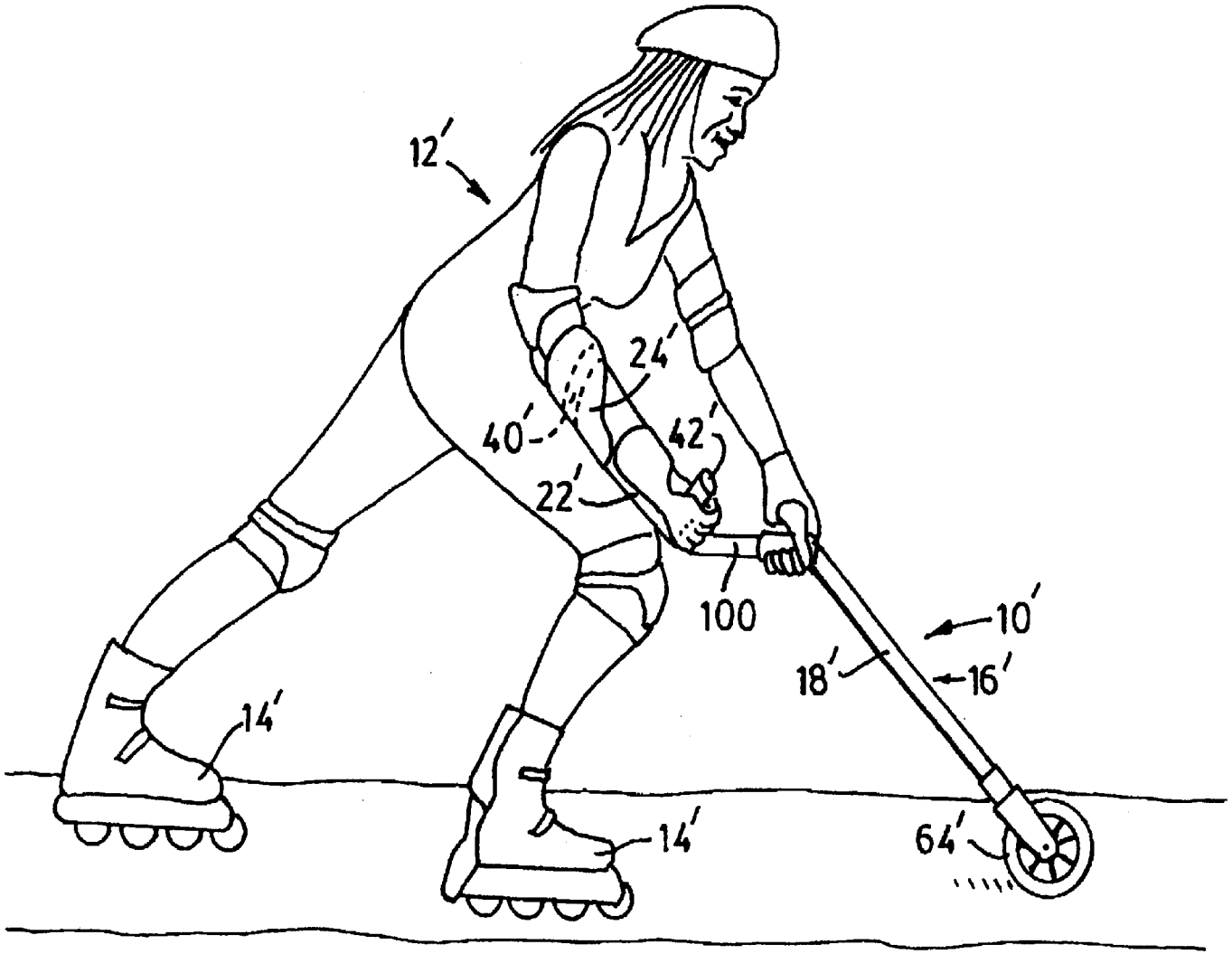
FIG. 9 is a side view of a skater using a second embodiment of the control device according to the invention.
Figure 10:
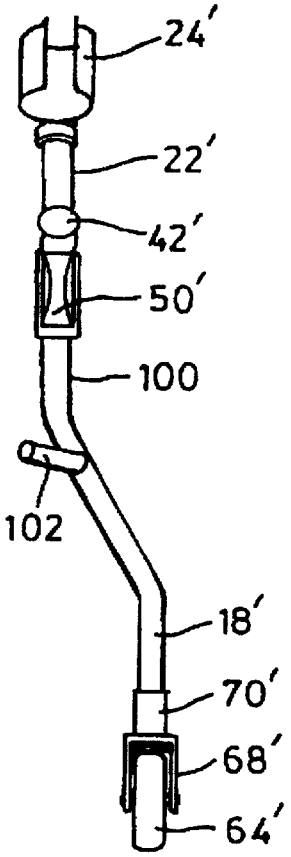
FIG. 10 is a front view of the device of FIG. 9.
Figure 11:
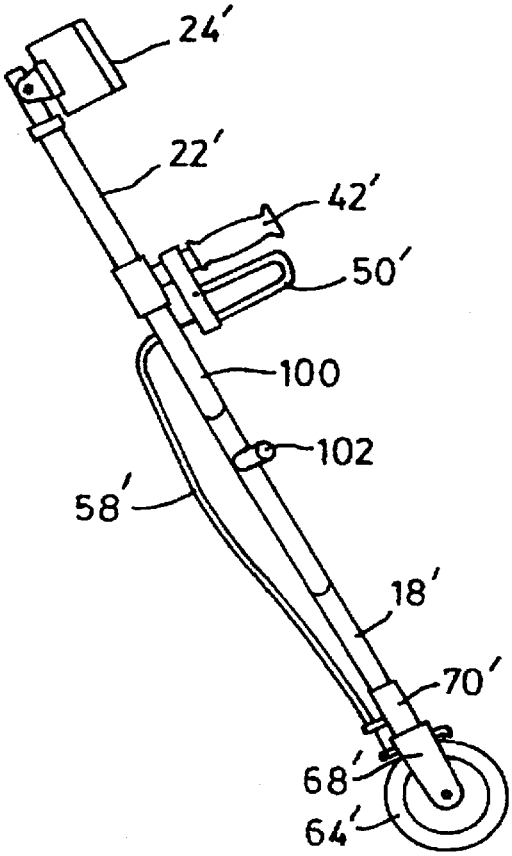
FIG. 11 is a side view of the device of FIG. 9.

In the first embodiment of the device described in connection with FIGS. 1 to 8, the shaft 16 is straight as viewed from the front. A second embodiment is shown in FIGS. 9 to 11, in which primed reference numerals indicate parts corresponding to those of FIGS. 1 to 8. In the FIGS. 9 to 11 embodiment, the shaft 16 is generally S-shaped, having an angled central portion 100 between its upper and lower portions 22', 18'. The angled central portion 100 extends from the upper portion 22' toward the center of the user's body. Therefore, for a right-handed person who attaches the device 10' to his/her right arm, the wheel 64' will be centered in front of the user's body, between his/her legs. This allows more stable triangulation and reduces the stresses on the user's right shoulder once the device has been grasped with both hands. This arrangement thus facilitates hard braking, as shown in FIG. 9. If desired, and as shown, the shaft 16 may include a second handle 102 projecting forwardly from the angled central portion 100, so that the user can grasp the second handle 102 with his/her free hand for additional support during emergency braking. A configuration with the center portion 100 extending in the opposite direction would be used for a left handed person. Alternatively, the second handle 102 may simply be a tubular grip around central portion 100.

Alternatively, the upper portion 22' and lower portion 18' may be rotatably connected to each other below the S-shaped portion. The upper portion 22' may then be rotated 180° relative to the lower portion to accommodate left-handed persons. The arm holder 24', handle 42' and brake lever 50' would similarly need to be rotated 180° relative to the upper portion 22' to accommodate left-handed users.

Figure 12:
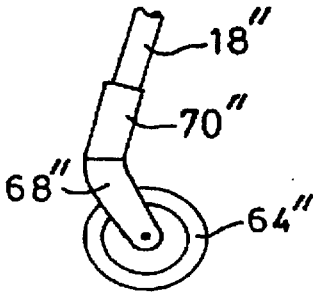
FIG. 12 is a side view of an alternate wheel arrangement for a device according to the invention.

If desired, and as shown in FIG. 12 where double primed reference numerals indicate parts corresponding to those of FIGS. 1 to 8, the fork 68" can trail rearwardly from collar 70", so that bumps in the road surface will tend to lift the wheel 64" rather than being transmitted straight up the shaft and through the user's arm to the user's shoulder.

Figure 13:
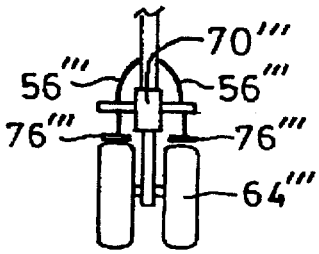
FIG. 13 is a front view of a further modified wheel arrangement for a device according to the invention.

A further modification of the device is shown in FIG. 13 (where triple primed reference numerals are used to indicate parts corresponding to those of FIGS. 1–8), in which the single braking wheel 64 is replaced by dual wheels 64'''. There is a brake pad 76''' for each wheel, with each brake pad being connected to the inner wire 56''' of the brake cable 58''' so that both can be operated by one brake lever. This offers additional stability and braking power, but at the cost of increased weight and bulk.

A third embodiment of the device is depicted at 200 in FIGS. 14 to 22. The device includes a shaft 202 that is molded from a high strength, light weight fiber reinforced composite material such as a glass filled polypropylene. The molded shaft 202 facilitates cost effective manufacture through injection molding or compression molding. As will be described below, many elements of the device are integrally molded with the shaft 202.

The shaft 202 preferably has a U-shaped cross-section with side walls 204 and a top surface 206. This cross-sectional shape provides structural strength that is comparable to that of a tubular shaft 202 while still facilitating low cost manufacture by molding. Alternative cross-sectional profiles having inverted open sections that are conducive to such simplified manufacture are also contemplated, such as a W-shaped cross-section.

The shaft 202 has an upper portion 208 and a lower portion 210 that are releasably interconnected. The lower portion 210 carries a wheel 212, and the upper portion 208 carries an arm holder 214. The upper portion 208 and lower portion 210 slidably overlap at an intermediate portion of the shaft 202 to facilitate an adjustable interconnection for different sized persons. The upper and lower portions 208, 210 of the shaft 202 may be disconnected and reversed so that the wheel assembly is positioned adjacent to the arm holder 214 to facilitate packaging or portability of the device in a more compact size. To further aid portability, the shaft 202 may comprise three or more portions that may be adjustably interconnected or disassembled into an even more compact size.

A plurality of connection openings 216 are defined transversely through the side walls 204 of the upper portion 208 at spaced intervals. A pair of connection openings 216 are also defined transversely through the side walls 204 of the upper end of the lower portion 210. The connection openings 216 are defined through bosses 218 that are molded into each side wall of the upper and lower portions 202, 210 of the shaft 202. The bosses 218 protrude from the outer surface of the upper portion 208 (to leave the inner surface free to slidably receive the lower portion 210) and from the inner surface of the lower portion 210 (to provide a smooth outer surface for slidable adjustment with the upper portion 208). The bosses 218 have generally planar surfaces 220 to facilitate a flush contact with the head and nut of a connection bolt as described below.

Figure 14:
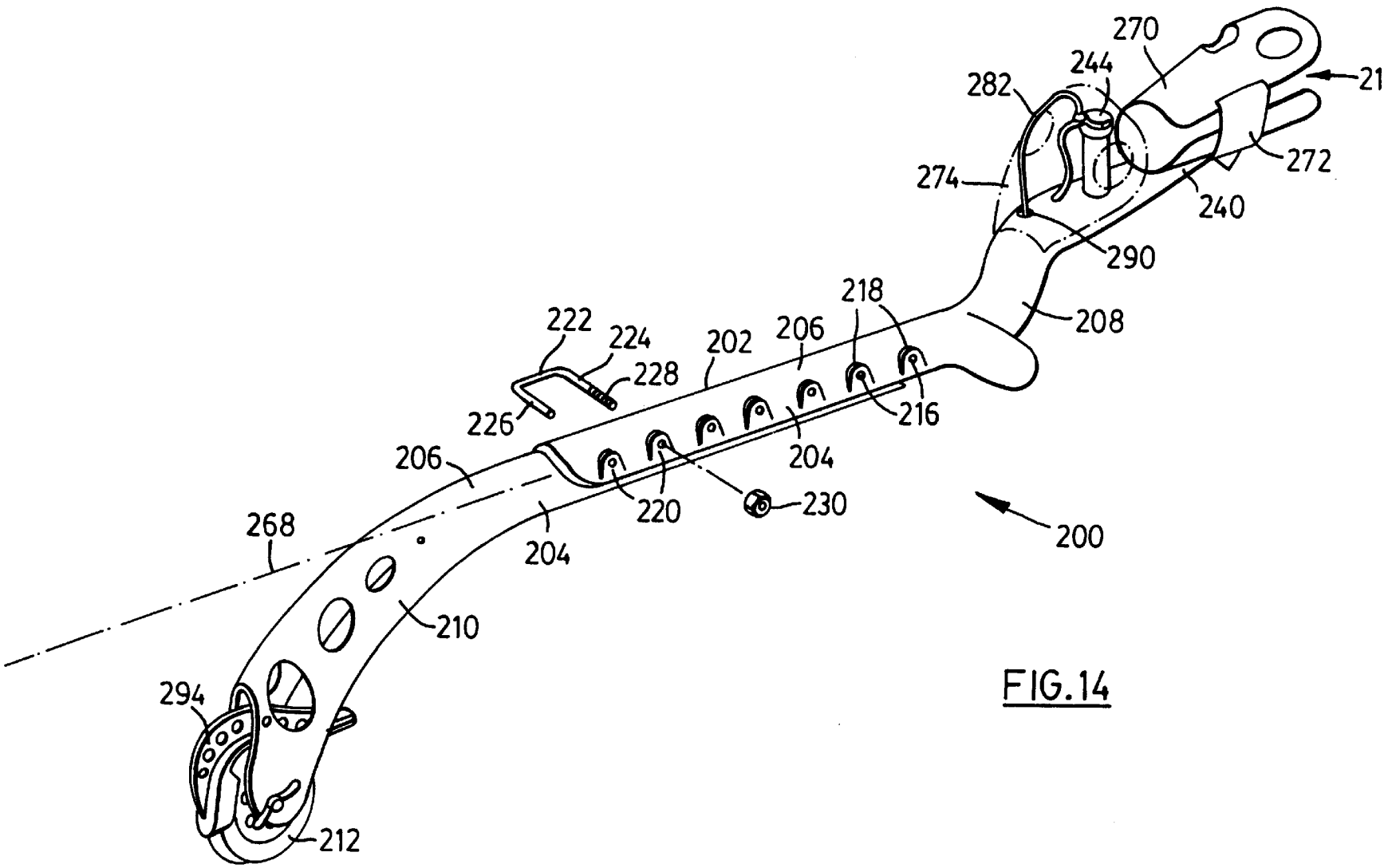
FIG. 14 is a perspective view of a third embodiment of a control device according to the invention.

Referring to FIG. 14, one arrangement for connecting the upper and lower portions 208, 210 together is shown. A U-shaped connection bolt 222 having first and second arms 224 and 226 fits into adjacent connection openings 216 in the overlapping portions. The first arm 224 is longer than the second arm 226 and includes threads 228 for receiving a corresponding nut 230 for securing the connection bolt 222 to the shaft 202. The two arms 224, 226 ensure that the portions 208, 210 are connected at at least two points along their length to prevent pivoting of one portion relative to another.

Figures 15A, 15B, 15C:
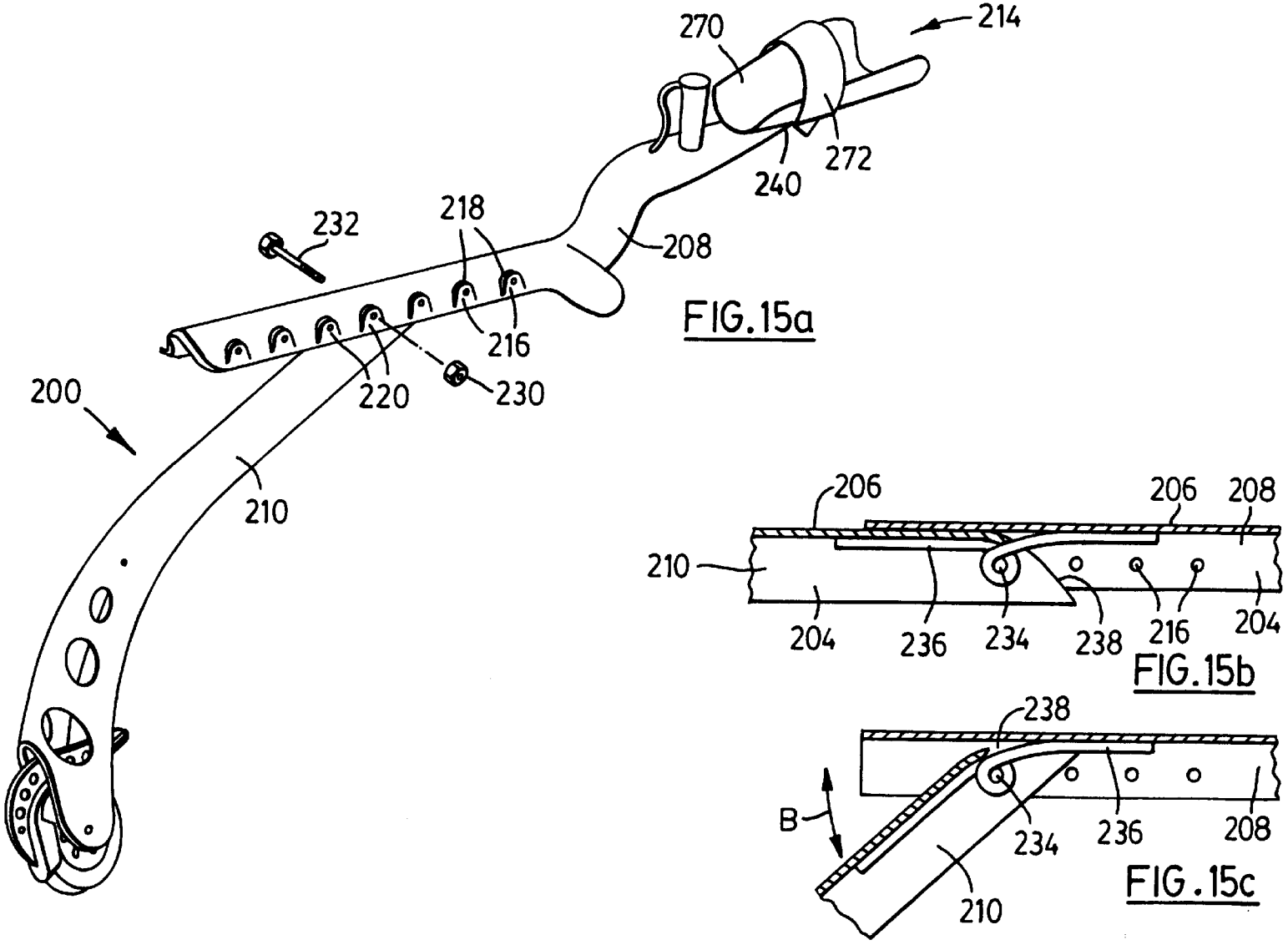
FIG. 15*a* is a perspective view of the device of FIG. 14 showing a spring biased hinge connector.
FIGS. 15*b* and *c* are partial longitudinal sectional views of the device of FIG. 15*a*.

Referring to FIGS. 15*a, b* and *c* an alternative connection arrangement is shown. In this arrangement, an elongate connection bolt 232 extends through the connection openings 216 as well as through an eyelet 234 of a torsion spring 236. The combination of the bolt 232 and torsion spring 236 provides a spring biased hinge connection between the upper and lower portions 208, 210. The torsion spring 236 may be mounted with rivets or the like to the end of the lower portion 210 of the shaft 202 or it may sit freely as shown. A single connection axis is defined by the bolt 232 to allow pivoting of the lower portion 210 relative to the upper portion 208. As shown in FIG. 15*c* the torsion spring 236 is biased to resist downward movement of the lower portion 210 relative to the upper portion 208 until a sufficient overcoming force is applied. This might occur for instance when a sudden jarring stop occurs such as when the wheel 212 of the device hits an obstruction. The torsion spring 236 would then dampen a portion of the jarring force that would otherwise be transferred up the shaft 202 to the skater's arm. As shown, an end 238 of the lower portion 210 is angled to limit the extent of downward pivoting movement relative to the upper portion 208. Once the lower portion pivots beyond a pre-set angle B (e.g. 45°), the angled end 238 abuts against the bottom surface of the upper portion 208 to restrict further rotation.

Figure 16:
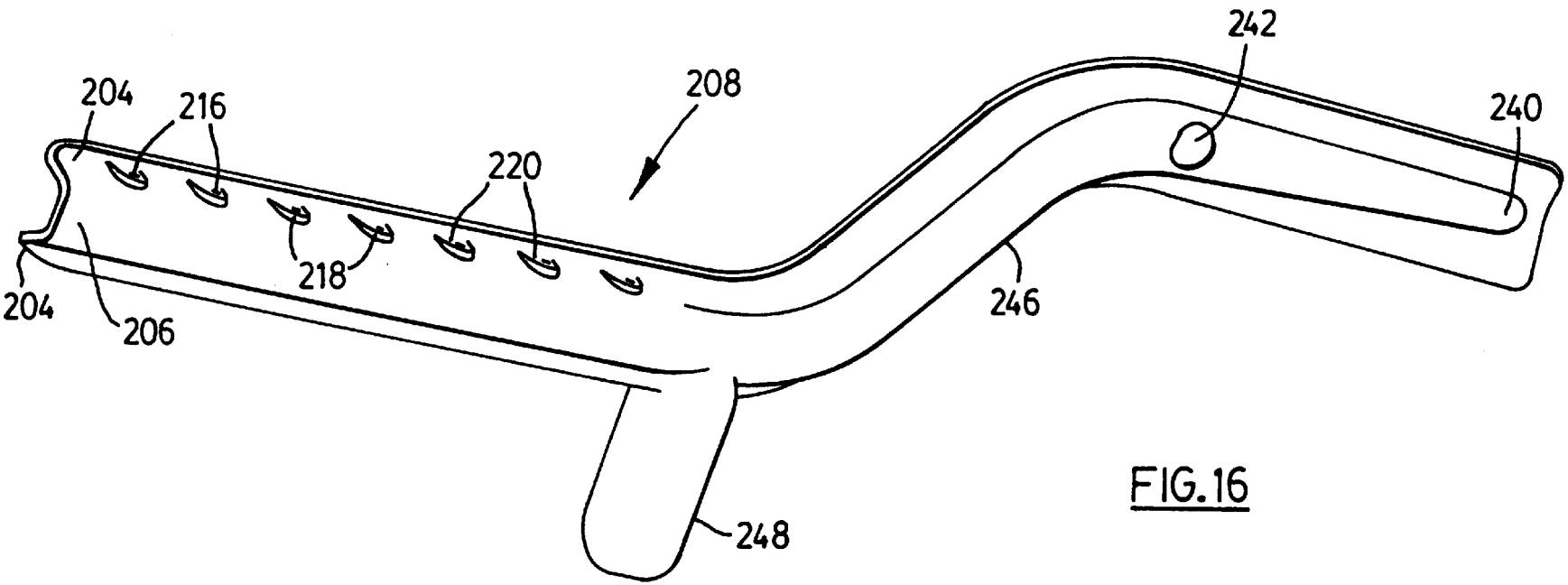
FIG. 16 is a top perspective view of the upper portion of the device of FIG. 14.
Figure 17:
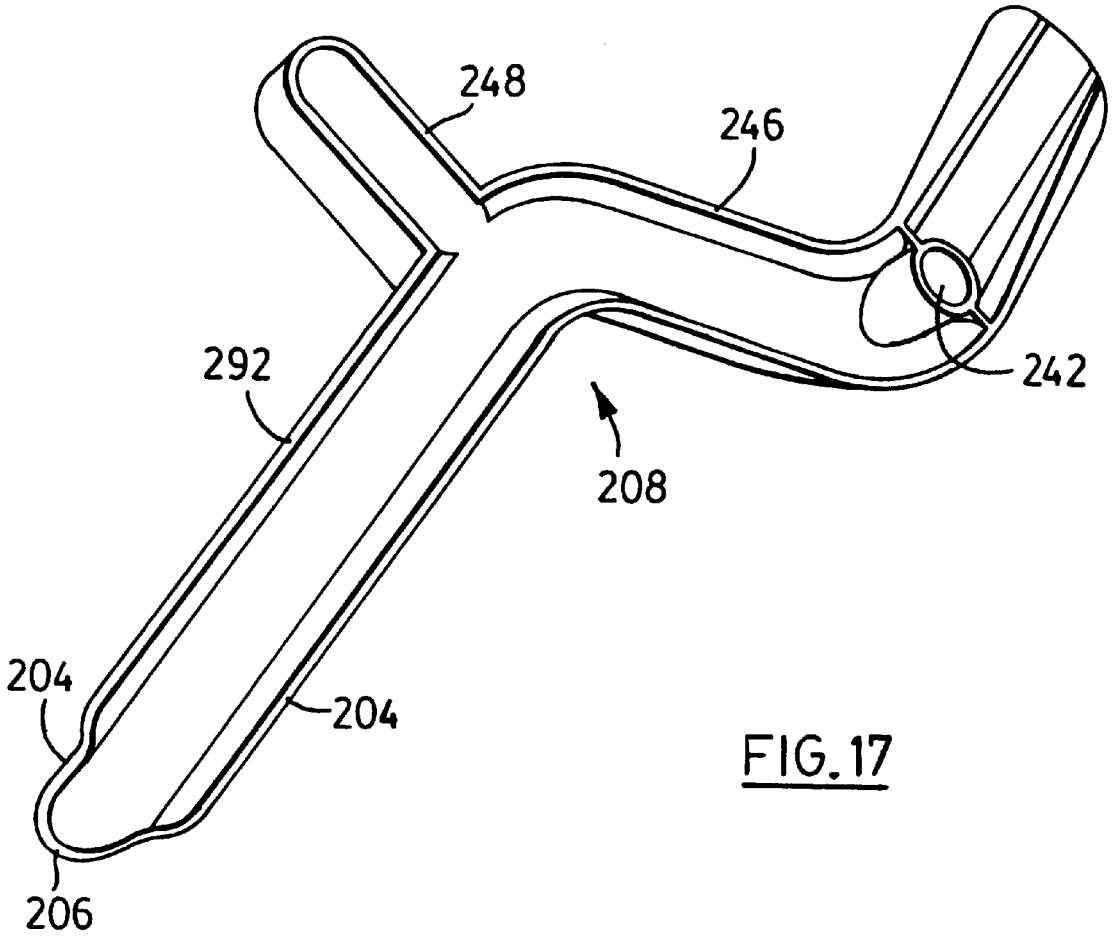
FIG. 17 is a bottom perspective view of the upper portion of the device of FIG. 14.

Referring to FIGS. 16 and 17, the upper portion 208 of the shaft 202 is shown in detail. It may be seen that the molded profile of the upper portion 208 changes from a downward facing U-shaped cross-section over a substantial portion of its length to a shallow upwardly facing U-shaped cross-section at its upper terminal end. The shallow upwardly facing U-shaped portion forms part of the arm holder 214 of the device and provides a base 240 for supporting the skater's forearm.

The molded upper portion 208 also includes an integrally molded bore 242 for receiving a handle 244 as explained further below. Furthermore, the upper portion 208 is molded with a general S-curve 246 so that its lower end, when connected to the lower portion 210, will position the wheel 212 of the device in a plane generally between the skater's feet. This provides an evenly balanced tripod support for the skater. The upper portion 208 also includes an integrally molded emergency handle 248 that extends at a right angle to the lower end below the S-curve 246. The emergency handle 248 may be gripped with the skater's free hand for added support during emergency braking.

Figure 18:
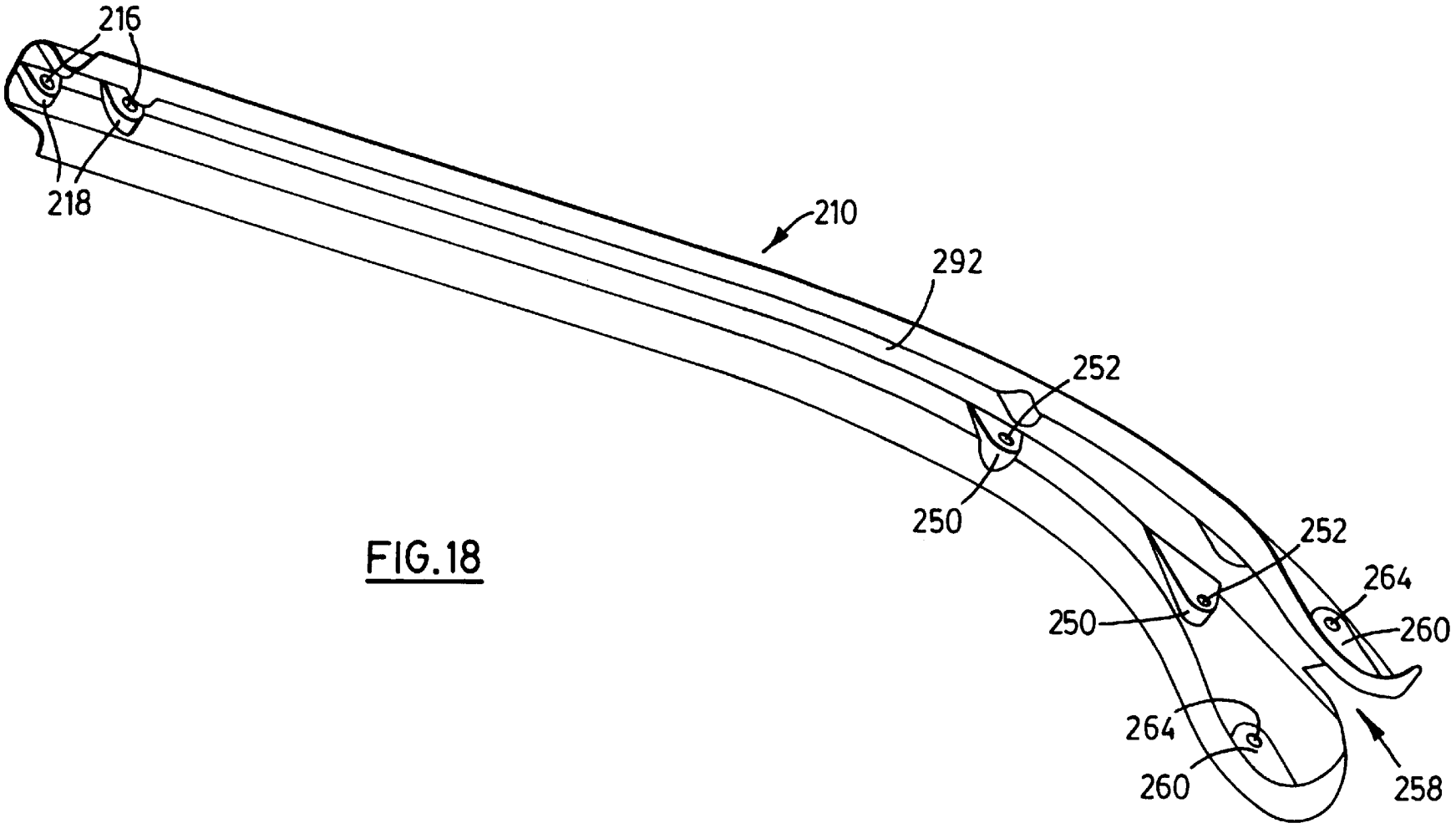
FIG. 18 is a bottom perspective view of the lower portion of the device of FIG. 14.
Figure 19:
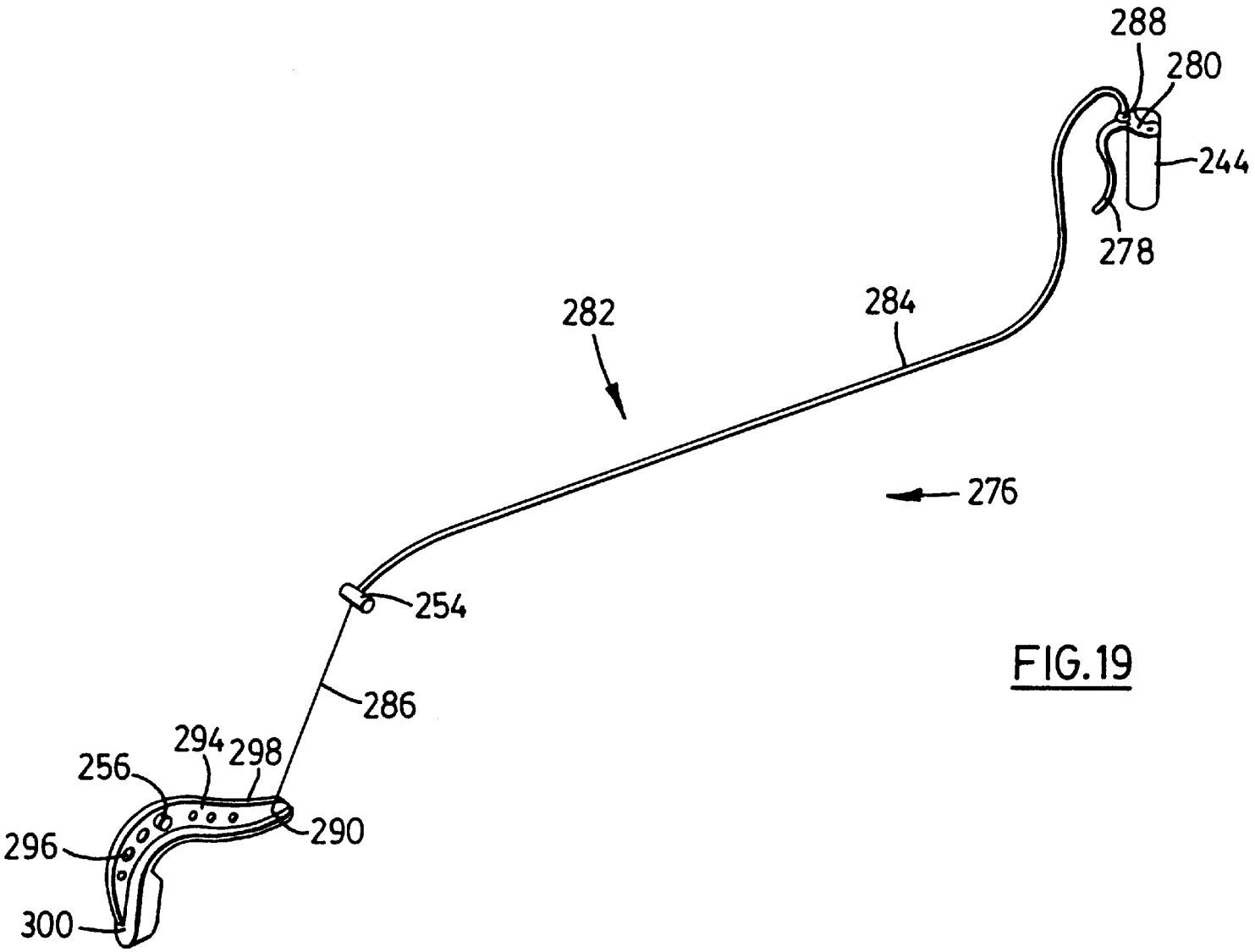
FIG. 19 is a perspective view of the braking assembly for the device of FIG. 14.

Referring to FIG. 18, the lower portion 210 of the shaft 202 is shown. The lower portion 210 includes upper and lower sets of integrally molded bosses 218 and 250. As previously discussed, the connection openings 216 are defined through the upper set of bosses 218. The lower set of bosses 250 define respective openings 252 for receiving a brake cable support pin 254 and a brake shoe support pin 256 as described further below.

The lower end of the lower portion 210 defines a wheel support member in the form of an integrally molded fork 258 having opposing walls 260 for rotatably supporting a shaft 262 for the wheel 212. The shaft 262 is supported in shaft openings 264 defined in the walls 260 and held in place with a nut 266, grub screw or other suitable fastener. Alternatively, the wheel support member could comprise a single wall 260 for rigidly supporting the full length of the shaft 262 from one end.

The lower portion 210 of the shaft 202 is molded with a downward curve relative to a longitudinal axis 268 of the shaft 202. The curved lower end positions the wheel 212 rearwardly of the shaft axis 268 in a positive caster that helps control the device during braking.

The arm holder 214 includes a cuff 270 that is attached to the upper portion 208 of the shaft 202 by glue, tape or rivets. The cuff 270 may be attached to the upper portion 208 by pins (not shown) that are slidably secured within longitudinal slots (not shown) defined in the base 240. This would facilitate adjustability of the cuff 270 relative to the handle 244 to account for different arm lengths. The cuff 270 envelops the skater's forearm and is adjustably secured to the skater's forearm by a VELCRO™ attachment strap 272 or the like. An optional shield 274 (shown in dotted outline in FIG. 14) is provided in front of the cuff 270 to cover the hand of the skater.

Referring to FIGS. 19–22, the brake assembly is shown generally at 276. The brake assembly 276 includes the handle 244 that is secured in the bore 242 that is integrally molded into the upper portion 208 of the shaft 202. The handle 244 is secured in place with glue, rivets, bolts or other suitable fasteners. Alternatively, the handle 244 may be integrally formed as part of the upper portion 208. A brake lever 278 is pivotally connected to the handle 244 by a pin 280. The pin 280 may be at the top of the handle (with the brake lever 278 pointing down as shown) or at the bottom of the handle (with the brake lever 278 pointing up which is not shown). Alternatively, the brake lever 278 and handle 244 may be integrally formed with a living hinge.

The brake lever 278 is connected to a conventional coaxial brake cable 282. The brake cable 282 includes an outer jacket 284 and an inner wire 286. The outer jacket 284 connects with a threaded collar 288 or other suitable means to a corresponding threaded neck (not shown) or the like on the brake lever 278. The inner wire 286 also attaches to the brake lever 278 in known manner. The brake cable 282 extends through an opening 290 defined in the upper portion 208 of the shaft 202 and runs along a cavity 292 defined by the underside of the shaft 202. The outer jacket 284 is supported at its lower end to the lower portion 210 of the shaft 202 with the brake cable support pin 254. The inner wire 286 extends beyond the outer jacket 284 and connects to a brake shoe 294 as described further below.

The brake shoe 294 is pivotally mounted to the lower portion 210 of the shaft 202 by the brake shoe support pin 256. The brake shoe 294 has a downwardly curved portion 296 that corresponds to the radius of curvature of the wheel 212 and an upwardly curved portion 298 that includes a connection opening 290 for attaching the inner wire 286. A brake pad 300 is attached to the bottom side of the brake shoe 294 with glue, rivets or other suitable fasteners. The brake pad 300 has a radius of curvature that corresponds to the curvature of the wheel 212.

Figure 22:
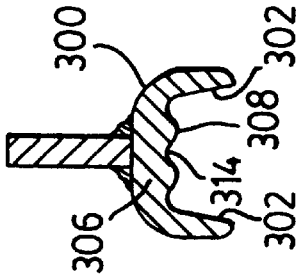
FIG. 22 is a sectional view of the brake shoe of FIG. 21 taken along lines 22—22.
Figure 21:
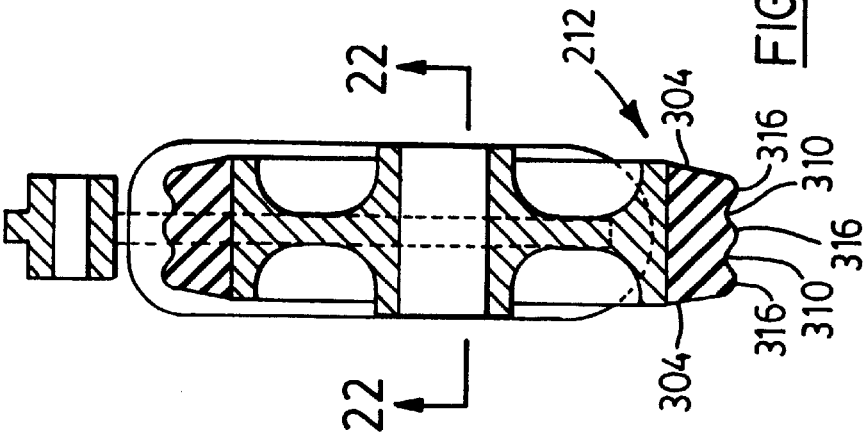
FIG. 21 is a front view of the brake shoe and wheel of FIG. 20.
Figure 20:
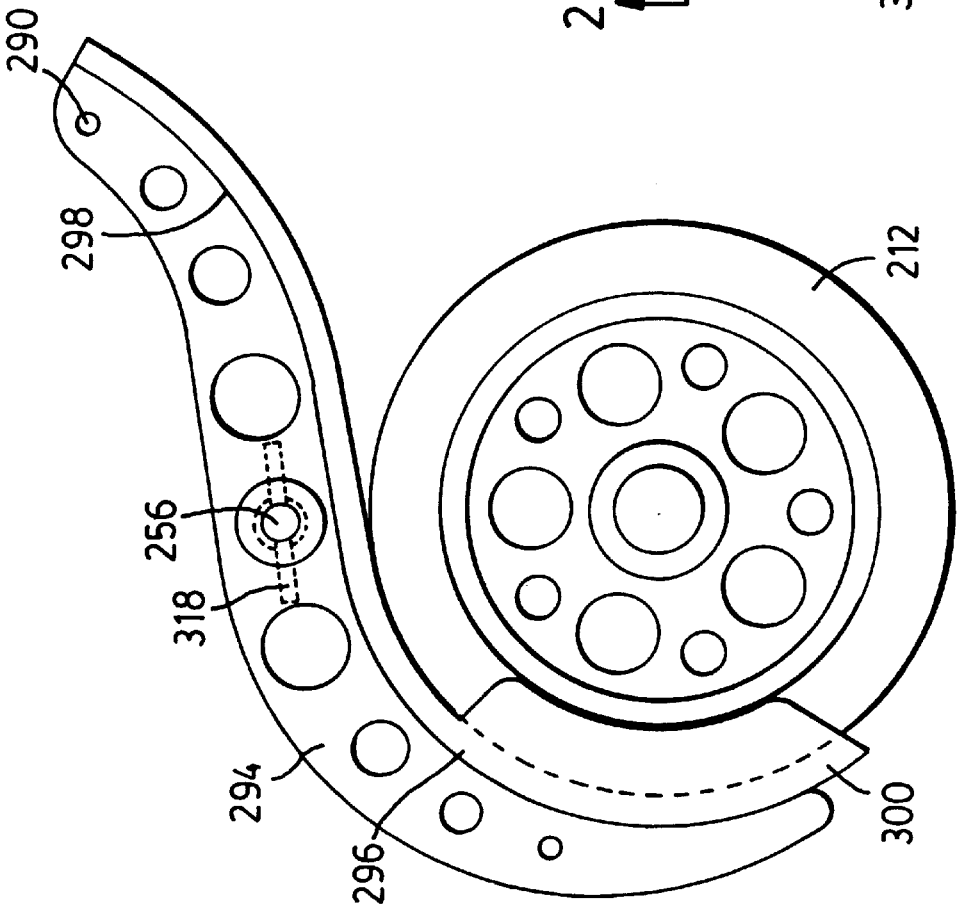
FIG. 20 is a side view of a brake shoe and wheel in accordance with the present invention.

Preferably, the brake pad 300 and the wheel 212 each have non-planar contacting surfaces that increase the surface area for frictional contact during braking. Referring to FIGS. 20–22, it may be seen that the brake pad 300 has converging side walls 302 for contacting corresponding converging side walls 304 of the wheel 212. In addition, the brake pad 300 has a head 306 with two protruding tongues 308 for frictionally contacting two corresponding grooves 310 defined in a ground contacting portion 312 of the wheel 212. Furthermore, the brake pad head 306 includes three grooves 314 for frictionally receiving three corresponding tongues 316 protruding from the wheel 212. The brake pad 300 has a sufficient length to engage a significant portion of the circumference of the wheel 212 (approximately 20% of the circumference is preferred) to optimize the braking force.

It will be understood that movement of the brake lever 278 causes a corresponding movement of the brake pad 300 relative to the wheel 212. When no braking force is applied, the brake pad 300 is biased away from the wheel by a torsion spring 318. Application of force on the brake lever 278 will cause engagement of the brake pad 300 with the wheel to allow precise control of the braking force. Thus, a light braking force may be applied to provide a slow rotary movement of the wheel for speed control or a strong braking force may be applied to stop the wheel during emergency braking.

Figure 23:
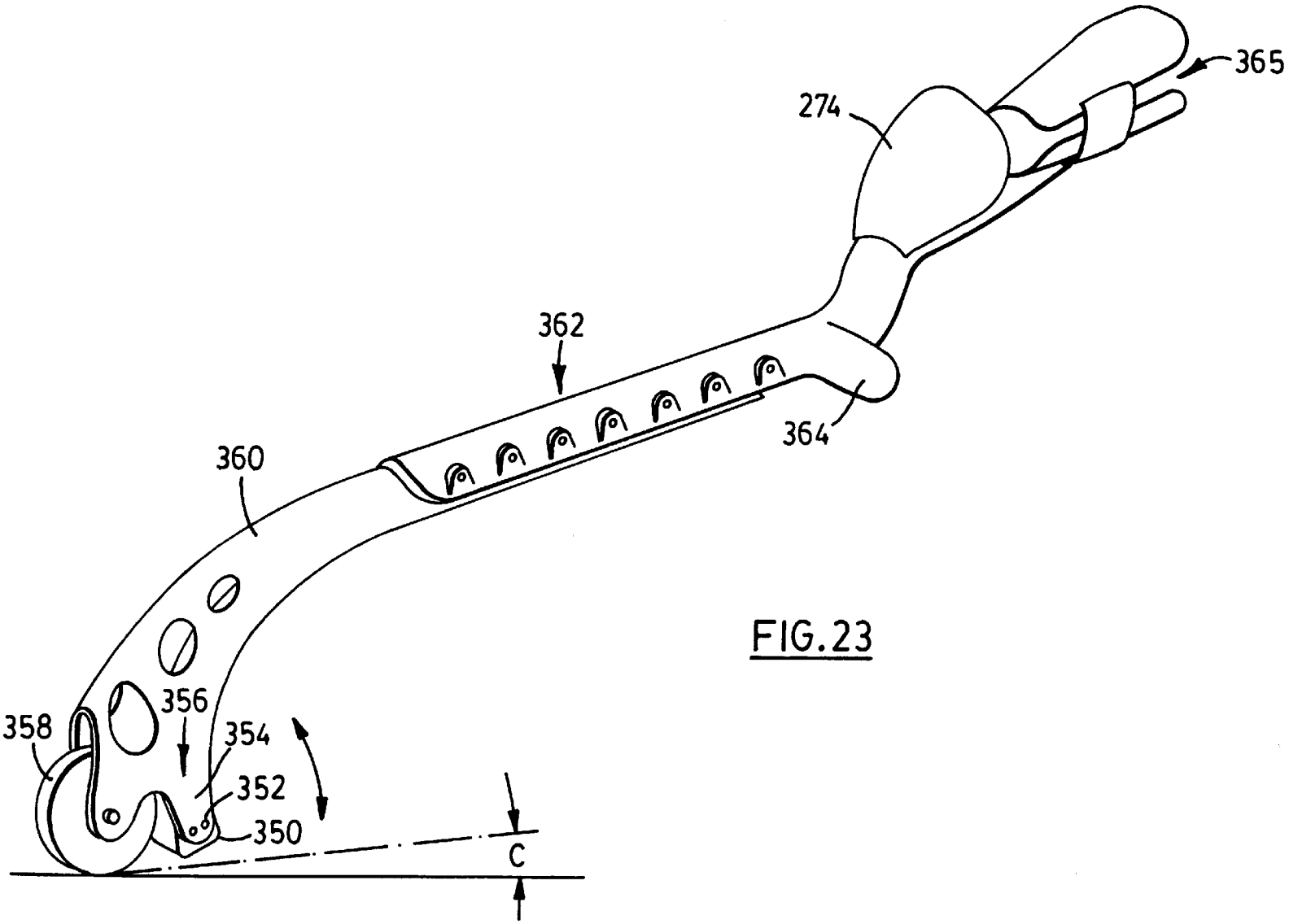
FIG. 23 is a perspective view of a fourth embodiment of a control device according to the invention.

Referring to FIG. 23, a fourth embodiment of the device is depicted. The device has a similar molded shaft construction to the device depicted in FIG. 14 however no brake actuation assembly is required. Instead, a brake pad 350 is mounted with pins 352 to opposing walls 354 of an integrally molded fork 356. The fork 356 is located upwardly and rearwardly from a wheel 358 on a lower portion 360 of a shaft 362. During regular skating, the shaft is raised above a critical angle C to avoid contact between the brake pad 350 and the ground. When the skater desires to slow down or stop, the skater lowers his hand or body to lower the shaft below the critical angle C. As a result, the brake pad 350 contacts the ground and the skater slows down. The skater may push downwardly upon an emergency handle 364 with his free hand to increase the braking force and steady himself with an arm holder 365 during braking.

Figure 24:
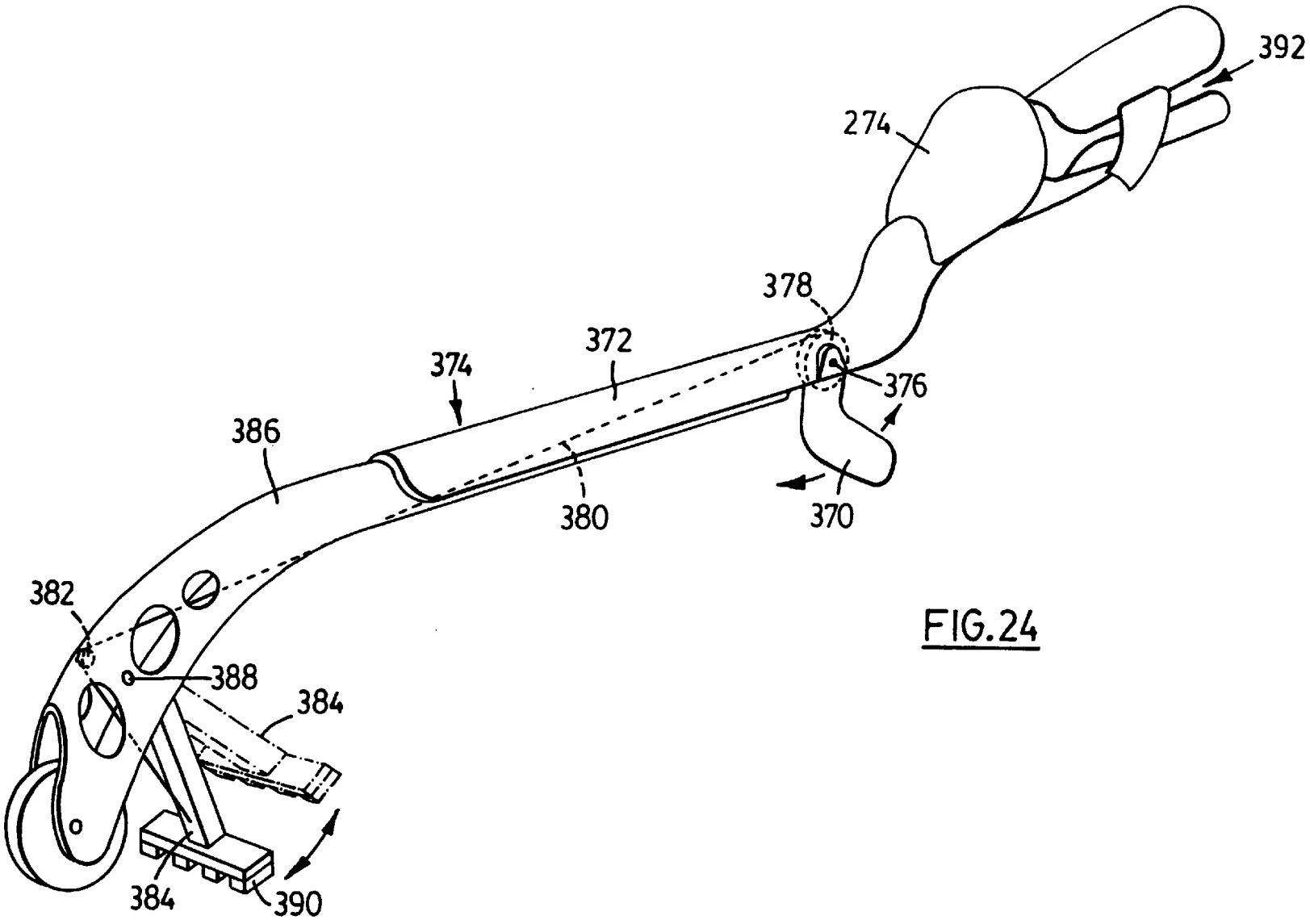
FIG. 24 is a perspective view of a fifth embodiment of a control device in accordance with the invention.

Referring to FIG. 24, a fifth embodiment of the device is depicted. The fifth embodiment has a similar molded shaft construction to the device depicted in FIG. 14 however it features a different braking assembly. The braking assembly includes a handle 370 that extends downwardly from an upper portion 372 of a shaft 374. The handle 370 is pivotally connected by a pin 376 to a cam 378. The cam 378, in turn, is connected to one end of a brake cable 380. The brake cable 380 extends down the shaft 374 over a support pin 382 and is connected at its other end to a brake shoe 384. The brake shoe 384 is pivotally connected to a lower portion 386 of the shaft 374 by a pin 388 and includes a brake pad 390 at its end. The brake shoe 384 pivots from a first position (shown in dotted outline) where it is raised upwardly and rearwardly along the shaft 374 to avoid engagement with the ground. Upon downward pivoting of the handle 370, the brake shoe 384 pivots downwardly and forwardly to a second position where ground contact is made. Frictional contact between the brake pad 390 and a ground surface then acts to control a skater's speed. It will be noted that the brake handle 370 is actuated with the skater's free hand (the left hand in the embodiment depicted) with the skater's right hand being supported in an arm holder 392 to steady the device.

It will be apparent that various additional changes may be made within the scope of the invention. For example the shaft need not be adjustable but can be made from one or more pieces to fit individual users. Various configurations may be used for the wheel or wheels, as desired. Various forms of commercially available braking mechanisms may be used, operating either on the surface of the wheel, on the rim of the wheel or on the ground. In addition, if desired, the upper portion of the shaft, and the arm holder, may be eliminated, so that the person simply firmly grips the handle with one hand, and when braking is desired swings the other hand into position to grip the device with both hands. While this arrangement has the advantage that it reduces the size of the device, it is not preferred since in unexpected emergency stops where the skater has little or no warning that his/her skates are about to stop rolling, the skater's grip on the device may not be sufficiently strong to provide effective triangulation and support, and the skater may not have sufficient time to swing his/her other arm to grasp the device to provide a sufficient grip. The presence of the arm holder essentially avoids this problem.

While various embodiments of the invention have been described, it will be appreciated that further changes may be made within the scope of the invention.

I claim:

1. A control device for a skater, said device comprising:

(a) an elongate body having an upper end and a lower end;

(b) a wheel support member located at said lower end of said body;

(c) a wheel rotatably connected to said wheel support member and positioned at a positive caster relative to said body;

(d) an arm holder located on said upper end of said elongate body for securing said skater's arm to said elongate body;

(e) a hand grip extending from said elongate body below said arm holder in a position to permit said hand grip to be gripped by one hand of the skater while said wheel contacts the ground forwardly of said skater; and (f) a brake assembly including a hand activated brake lever that is operatively connected to a brake shoe having a brake pad for braking rotary movement of said wheel, the brake lever being located proximate to said hand grip and operable by said one hand of the skater.

2. A device as claimed in claim 1, wherein said body has a U-shaped cross-section over a substantial portion of its length.

3. A device as claimed in claim 1, wherein said body has at least two portions that are adjustably interconnected with a connector for adjusting the length of said body.

4. A device as claimed in claim 1, wherein said body has an upper portion and a lower portion, said upper portion and lower portion being connected by a spring biased hinge connector.

5. A method for learning to skate on wheeled skates, comprising the steps of:

(a) obtaining a control device having an elongate body with a wheel rotatably connected to a lower end and a handle located at an upper end, said handle including an arm holder for securing a user's arm to the elongate body, a hand grip extending from the handle and located below said arm holder and a brake lever located proximate to said hand grip for operating a brake to control movement of the device relative to the ground;

(b) holding the hand grip of the device in one hand and resting the wheel of the device on the ground forwardly of the user's skates;

(c) gripping the brake lever with one hand;

(d) leaning toward the elongate body of the control device while gripping the brake lever a sufficient amount to maintain a balanced position; and (e) pushing forwardly on the skates while controlling speed with the brake lever.

* * * * *